US009175921B2

(12) United States Patent
Hughes

(10) Patent No.: US 9,175,921 B2
(45) Date of Patent: Nov. 3, 2015

(54) PORTABLE BENCH

(71) Applicant: Russell Scott Hughes, Graham, TX (US)

(72) Inventor: Russell Scott Hughes, Graham, TX (US)

( * ) Notice: Subject to any disclaimer, the term of this patent is extended or adjusted under 35 U.S.C. 154(b) by 0 days.

(21) Appl. No.: 14/050,273

(22) Filed: Oct. 9, 2013

(65) Prior Publication Data

US 2015/0096216 A1 Apr. 9, 2015

(51) Int. Cl.

| | |
|---|---|
| ***A47B 3/06*** | (2006.01) |
| ***F41A 23/12*** | (2006.01) |
| ***F41A 23/16*** | (2006.01) |

(52) U.S. Cl.

CPC ..... *F41A 23/12* (2013.01); *F41A 23/16* (2013.01)

(58) Field of Classification Search

CPC ..... A47C 16/02; A47B 3/14; A47B 13/021
USPC ..... 108/157.15, 157.1, 158; 297/175, 297/423.41

See application file for complete search history.

(56) References Cited

U.S. PATENT DOCUMENTS

| | | | | | |
|---|---|---|---|---|---|
| 1,747,691 | A | * | 2/1930 | Bellows | 108/156 |
| 1,762,776 | A | * | 6/1930 | Gardner | 108/156 |
| 2,673,772 | A | * | 3/1954 | Beasley | 108/156 |
| 2,962,086 | A | * | 11/1960 | Waltimyer | 297/423.41 |
| 4,011,821 | A | | 3/1977 | Neal | |
| D259,497 | S | * | 6/1981 | Mahler | D21/338 |
| 4,525,559 | A | | 6/1985 | Sielfeld et al. | |
| 4,702,029 | A | | 10/1987 | DeVaul et al. | |
| 5,096,186 | A | * | 3/1992 | Wilkinson et al. | 108/12 |
| 5,127,647 | A | * | 7/1992 | Wilkinson | 108/12 |
| 5,284,280 | A | | 2/1994 | Stonebraker et al. | |
| 5,556,181 | A | * | 9/1996 | Bertrand | 108/147.19 |
| 5,688,024 | A | * | 11/1997 | Arizpe-Gilmore | 297/217.1 |
| 5,918,550 | A | * | 7/1999 | Weir et al. | 108/157.11 |
| D430,759 | S | * | 9/2000 | Zarker, Jr. | D6/480 |
| 6,976,434 | B2 | * | 12/2005 | Roig et al. | 108/25 |
| 7,975,627 | B2 | * | 7/2011 | Leng | 108/156 |
| 8,245,650 | B1 | * | 8/2012 | McKsymick | 108/25 |
| 8,474,916 | B2 | * | 7/2013 | Smith | 297/440.1 |

* cited by examiner

*Primary Examiner* — Jose V Chen
(74) *Attorney, Agent, or Firm* — Plager Schack LLP

(57) ABSTRACT

A shooting bench is configured to be portable and stable. The shooting bench includes a tabletop mechanically coupled to three leg assembly sockets wherein each assembly socket contains an angled cavity that is angled at 10 to 30 degrees from perpendicular to the tabletop. A catch assembly, a cradle assembly and a handle are mechanically coupled to the tabletop. In a first mode of operation a leg assembly is inserted into each leg assembly socket wherein each angled cavity causes the shooting bench to be stable. In a second mode of operation, each leg assembly is inserted into the catch assembly and the cradle assembly in order store the leg assemblies making the shooting bench portable.

3 Claims, 4 Drawing Sheets

PORTABLE BENCH

BACKGROUND

The embodiments herein relate generally to furniture that can be used to support a user holding a firearm.

Prior to embodiments of the disclosed invention, a stable portable shooting bench evaded discovery. Rather, shooting benches were either very large and stable, but not portable or very light and portable, but unstable. Embodiments of the disclosed invention solve this problem. The prior art includes U.S. Pat. No. 5,284,280 issued to Stonebraker; U.S. Pat. No. 4,702,029 issued to DeVaul; U.S. Pat. No. 4,525,559 issued to Hall; U.S. Pat. No. 4,011,821 issued to Neal.

Stonebraker teaches a table with removable legs stored in "side pockets" on a "backpack" instead of clips on the table itself. DeVaul teaches removable legs that can be stored overlapping upon one another in a case which is carried with a handle, but does not utilize clips to hold the legs in place. Both Hall and Neal teach a table with a handle that has removable legs, which can be stored in clips on the table. However, Hall and Neal appear to be press fit into place and embodiments of the present invention use screw fitting.

SUMMARY

A shooting bench is configured to be portable and stable. The shooting bench comprises a tabletop mechanically coupled to a front leg assembly socket, a right leg assembly socket and a left leg assembly socket wherein each leg assembly socket contains an angled cavity that is angled at 10 to 30 degrees from perpendicular to the tabletop. A catch assembly is mechanically coupled to the tabletop. A cradle assembly is mechanically coupled to the tabletop. A handle is attached to the tabletop and is configured to permit carrying of the shooting bench. In a first mode of operation a front leg assembly is inserted into the front leg assembly socket, a right leg assembly is inserted into the right leg assembly socket and a left leg assembly is inserted into the left leg assembly socket wherein each angled cavity causes the shooting bench to be stable. In a second mode of operation, the front leg assembly, the right leg assembly and the left leg assembly are inserted into the catch assembly and the cradle assembly in order store the front leg assembly, the right leg assembly and the left leg assembly making the shooting bench portable.

In some embodiments, the catch assembly further comprises a catch assembly mounting mechanically coupled to a front catch clip, a right catch clip and a left catch clip. The cradle assembly further comprises a cradle assembly mounting mechanically coupled to a front cradle, a right cradle and a left cradle.

In some embodiments, the right leg assembly comprises a right leg is immediately adjacent right leg fixture. The right leg fixture is immediately adjacent to a right leg flange. The right leg flange is mechanically coupled to a right leg threaded stud which is threaded through the right leg assembly socket and into the tabletop. The left leg assembly comprises a left leg is immediately adjacent left leg fixture. The left leg fixture is immediately adjacent to a left leg flange. The left leg flange is mechanically coupled to a left leg threaded stud which is threaded through the left leg assembly socket and into the tabletop. The front leg assembly comprises a front leg is immediately adjacent front leg fixture. The front leg fixture is immediately adjacent to a front leg flange. The front leg flange is mechanically coupled to a front leg threaded stud which is threaded through the front leg assembly socket and into the tabletop.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
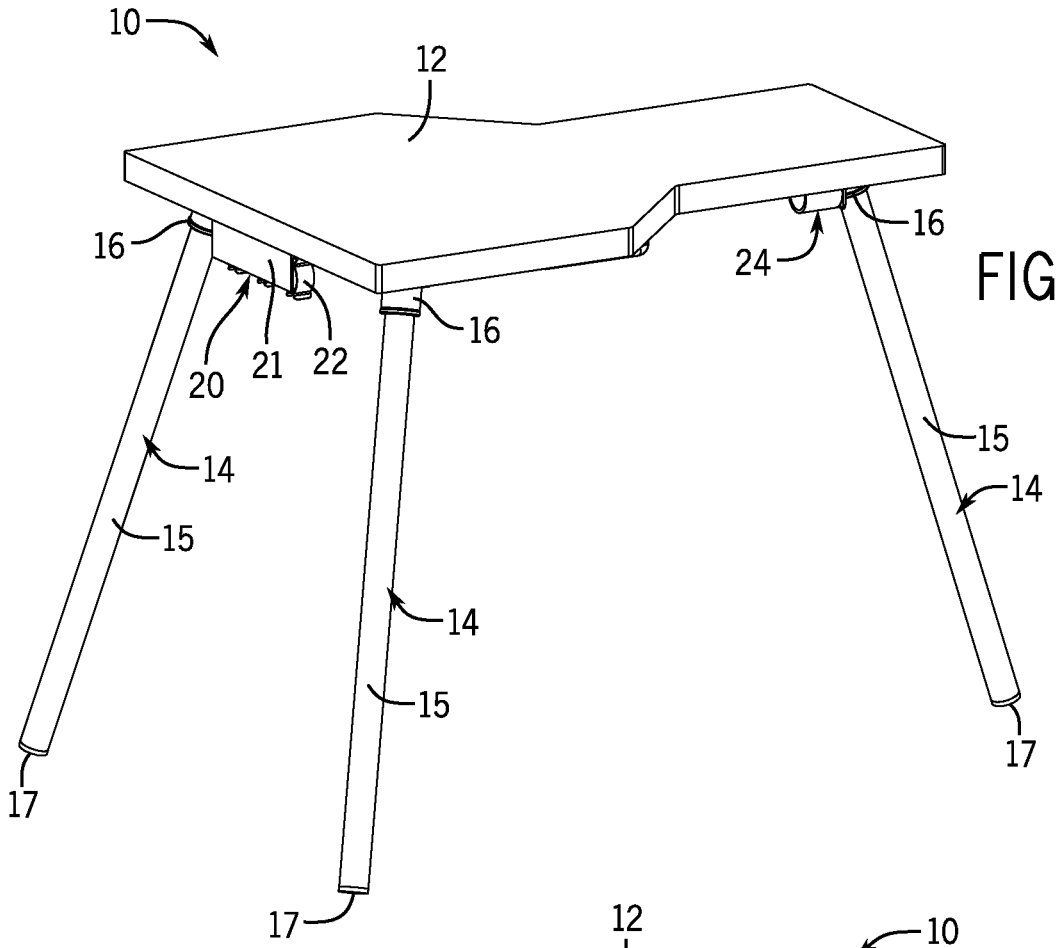
FIG. 1 is a front perspective view of an embodiment of the invention.
Figure 2:
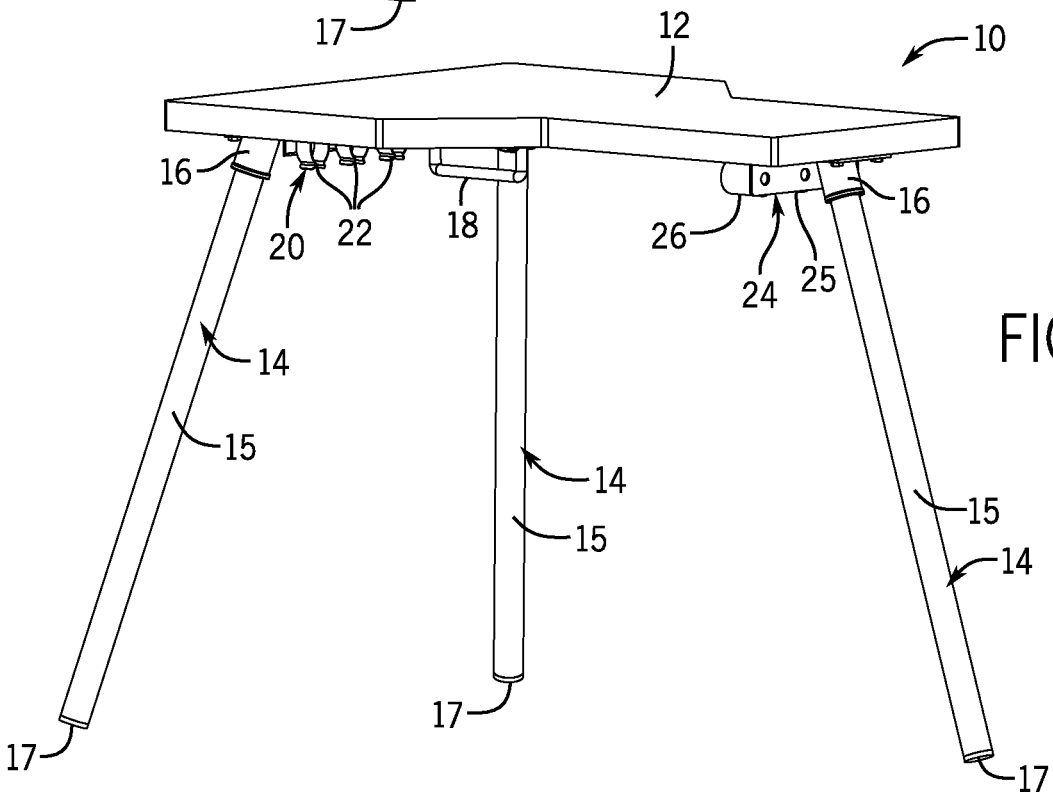
FIG. 2 is a front perspective view of an embodiment of the invention from a different angle.

By way of example, and referring to FIG. 1 and FIG. 2, one embodiment of shooting bench 10 comprise table top 12 mechanically coupled to front leg assembly socket 16, right leg assembly socket 16 and left leg assembly socket 16. Front leg assembly socket 16 is mechanically coupled to front leg assembly 14. Front leg assembly 14 comprises front leg 15 mechanically coupled to front leg end cap 17. Similarly, right leg assembly socket 16 is mechanically coupled to right leg assembly 14. Right leg assembly 14 comprises right leg 15 mechanically coupled to right leg end cap 17. Likewise, left leg assembly socket 16 is mechanically coupled to left leg assembly 14. Left leg assembly 14 comprises left leg 15 mechanically coupled to left leg end cap 17.

Figure 3:
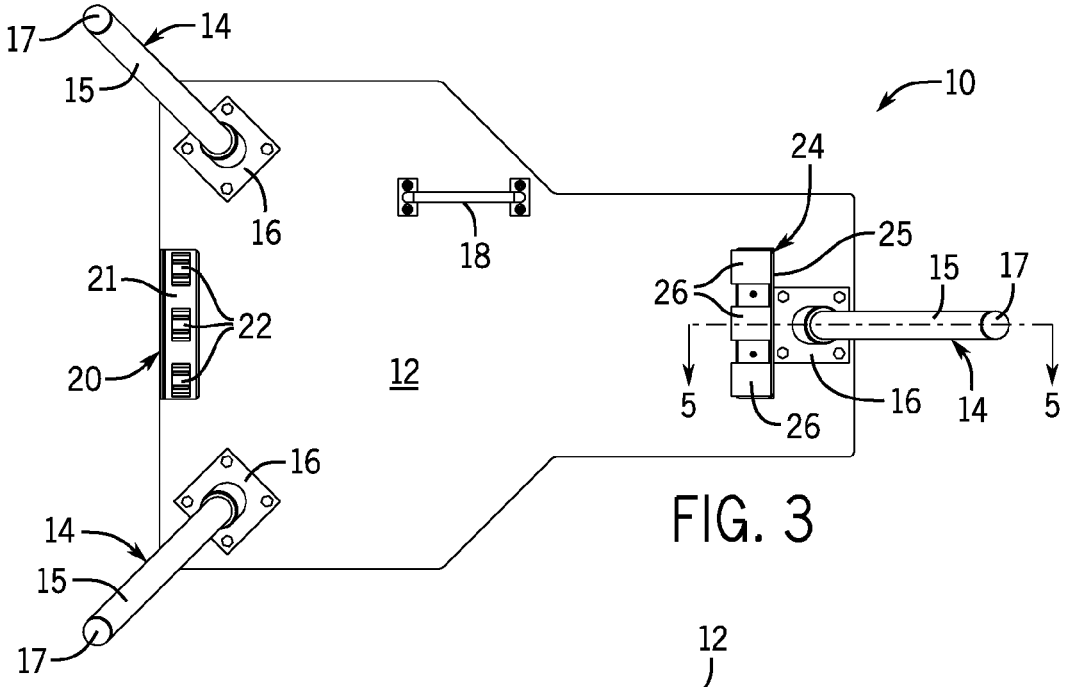
FIG. 3 is a bottom plan view of an embodiment of the invention.
Figure 4:
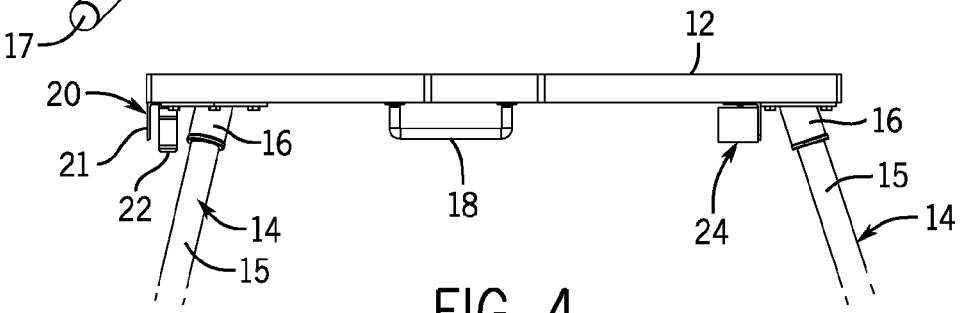
FIG. 4 is partial front elevation view of an embodiment of the invention.

Turning to FIG. 3 and FIG. 4, tabletop 12 is mechanically coupled to handle 18. Handle 18 can be used to carry shooting bench 10 making shooting bench 10 portable.

Tabletop 12 is further attached to catch assembly 20. Catch assembly 20 comprises catch assembly mounting 21 mechanically coupled to coupled to catch clips 22. Tabletop 12 is further mechanically coupled to cradle assembly 24. Cradle assembly 24 comprises cradle assembly mounting 25 mechanically coupled to cradles 26.

Figure 5:
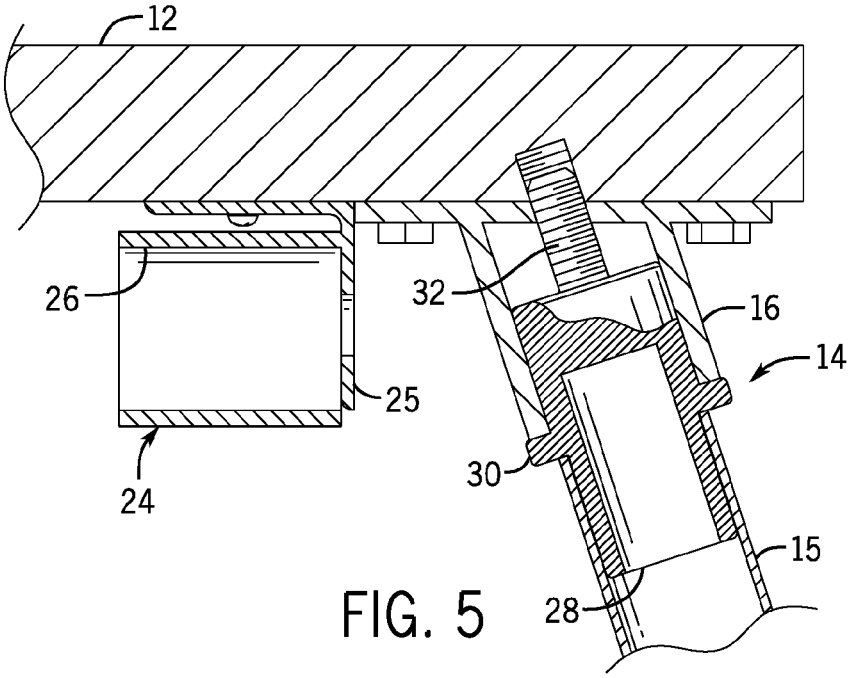
FIG. 5 is a cross-sectional view of an embodiment of the invention taken on the line 5-5 of FIG. 3.

FIG. 4 and FIG. 5 show shooting bench 10 in a first mode of operation wherein the leg assemblies 14 are deployed. Right leg 15 is immediately adjacent right leg fixture 28. Right leg fixture 28 is immediately adjacent to right leg flange 30. Right leg flange 30 is mechanically coupled to right leg threaded stud 32. Right leg threaded stud 32 is threaded through an angled cavity in right leg assembly socket 16 and into tabletop 12 at an angle that can range from 10 degrees to 30 degrees from perpendicular to tabletop 12.

Likewise, left leg 15 is immediately adjacent to left leg fixture 28. Left leg fixture 28 is immediately adjacent to left leg flange 30. Left leg flange 30 is mechanically coupled to left leg threaded stud 32. Left leg threaded stud 32 is threaded through an angled cavity in left leg assembly socket 16 and into tabletop 12 at an angle that can range from 10 degrees to 30 degrees from perpendicular to tabletop 12.

Similarly, front leg 15 is immediately adjacent to front leg fixture 28. Front leg fixture 28 is immediately adjacent to front leg flange 30. Front leg flange 30 is mechanically coupled to front leg threaded stud 32. Front leg threaded stud 32 is threaded through an angled cavity in front leg assembly socket 16 and into tabletop 12 at an angle that can range from 10 degrees to 30 degrees from perpendicular to tabletop 12 at an angle that can range from 10 degrees to 30 degrees from perpendicular to tabletop 12.

Figure 6:
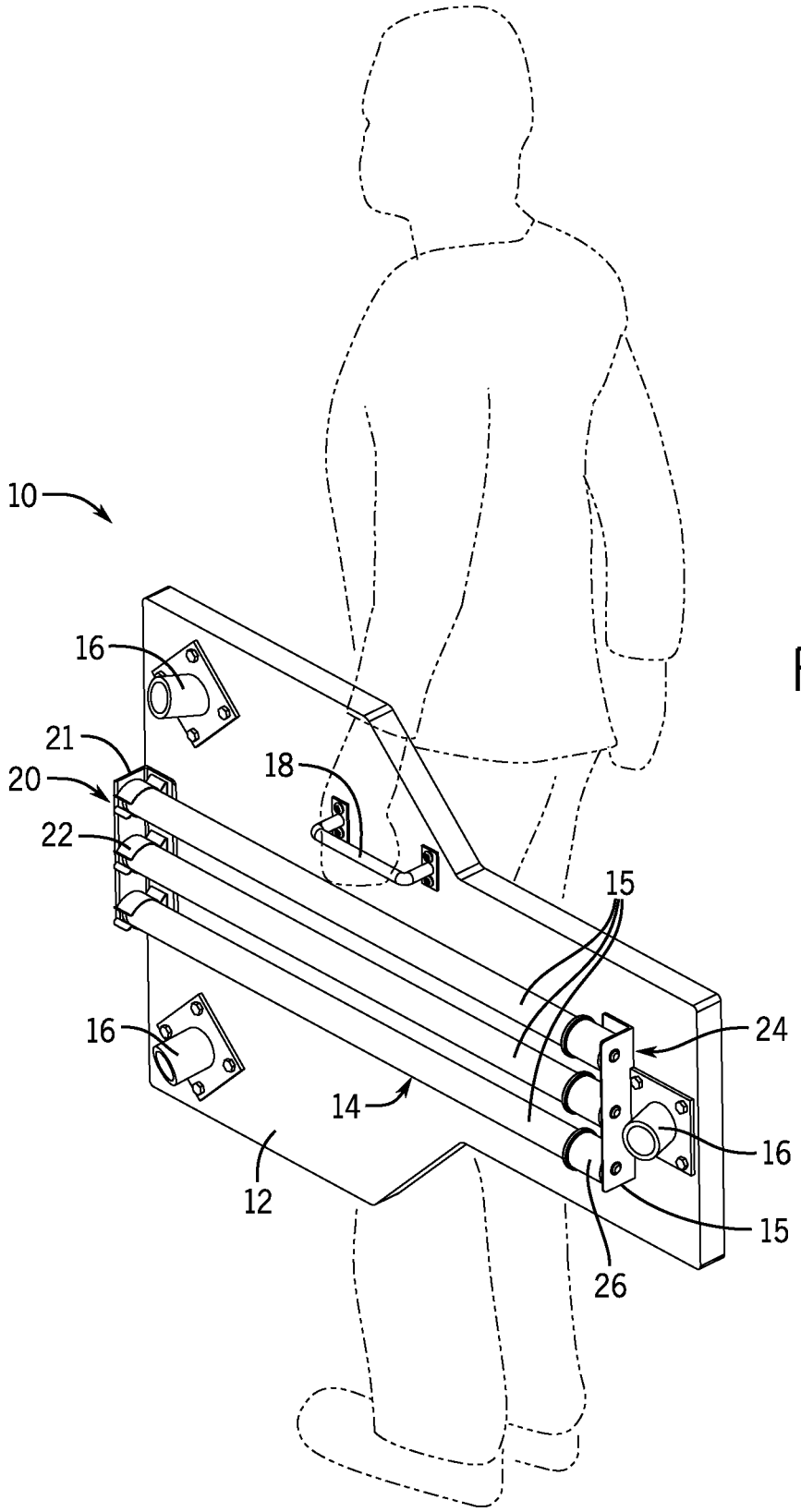
FIG. 6 is a perspective view of an embodiment of the invention in the portable mode.

FIG. 6 shows shooting bench 10 in a second mode of operation wherein the leg assemblies 14 are cradled. Here, front leg assembly 14 is inserted into front cradle 26 and front catch clip 22. Similarly, right leg assembly 14 is inserted into right cradle 26 and right catch clip 22. Likewise, left leg assembly 14 is inserted into left cradle 26 and left catch clip 22. When all leg assemblies 14 are inserted into cradles 26, then the leg assembles 14 are cradled and can be easily transported.

Figure 7:
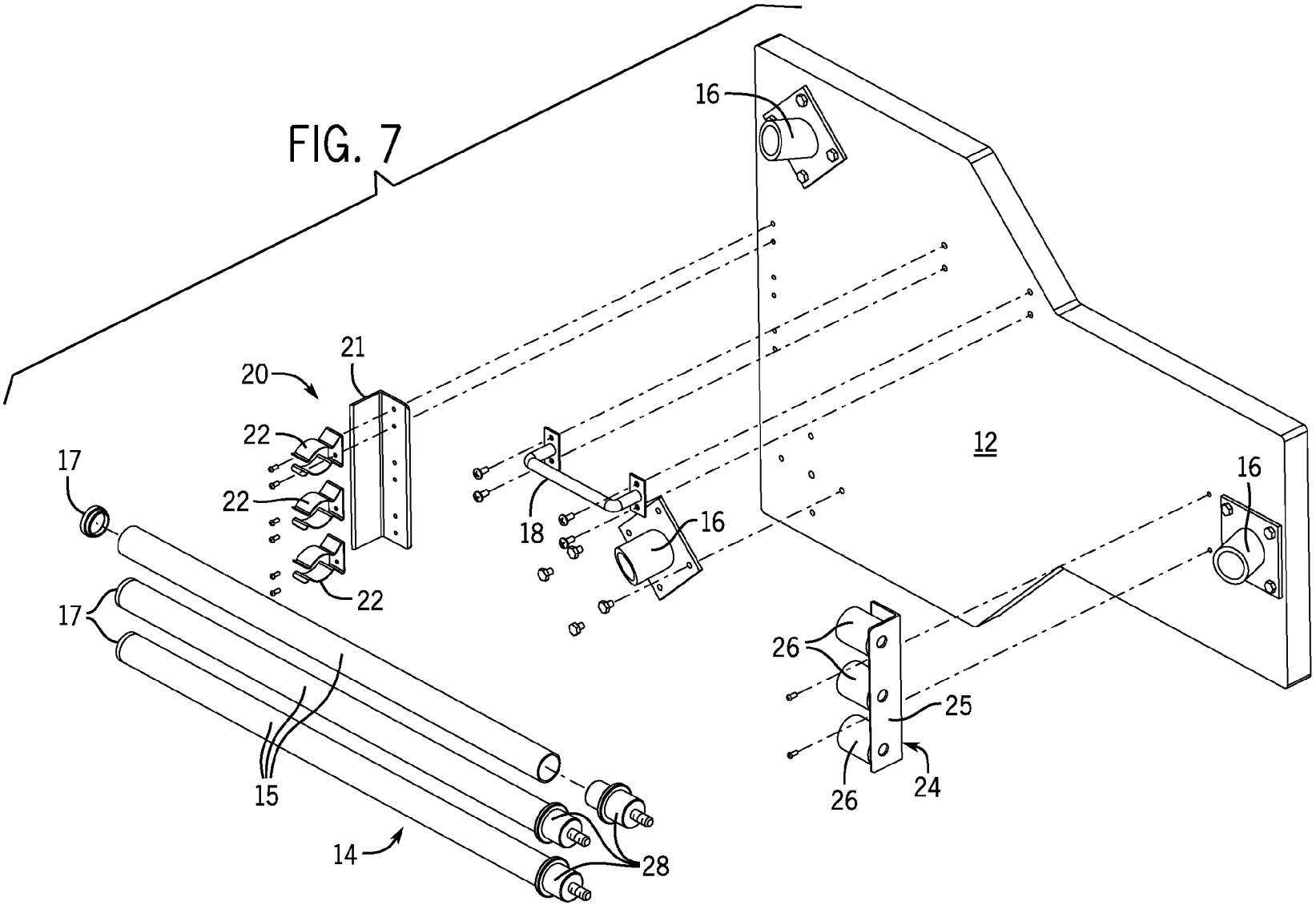
FIG. 7 is an exploded perspective view of an embodiment of the invention.

FIG. 7 shows one theory for assembling shooting bench 10 with fasteners. Of course, other methods of assembly can be used depending on user preference.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A shooting bench configured to be portable and stable; the shooting bench comprising:

a tabletop, having a wide rectangular end joined to a trapezoidal transition portion that contracts to a narrow rectangular end and is attached to exactly three leg assembly sockets consisting of a front leg assembly socket entirely within the narrow rectangular end, a right leg assembly socket and a left leg assembly socket entirely within the wide rectangular end wherein each leg assembly socket contains an angled cavity that is angled at 10 to 30 degrees from perpendicular to the tabletop;

wherein the front leg assembly socket is angled away from a front side of the table top at the narrow end;

wherein the a right leg assembly socket is angled away from a rear side and a right side of the table top at the wide end;

wherein the a left leg assembly socket is angled away from a rear side and a left side of the table top at the wide end;

wherein the front side is parallel to the rear side; wherein the left side is parallel to the right side;

a catch assembly mechanically coupled to the tabletop;

a cradle assembly mechanically coupled to the tabletop;

a handle attached to the tabletop within the trapezoidal transition portion configured to permit carrying of the shooting bench;

wherein a first mode of operation a front leg assembly is inserted into the front leg assembly socket, a right leg assembly is inserted into the right leg assembly socket and a left leg assembly is inserted into the left leg assembly socket wherein each angled cavity causes the shooting bench to be stable;

wherein a second mode of operation the front leg assembly, the right leg assembly and the left leg assembly are inserted into the catch assembly and the cradle assembly in order store the front leg assembly, the right leg assembly and the left leg assembly making the shooting bench portable.

2. The shooting bench of claim 1, wherein the catch assembly further comprises catch assembly mounting mechanically coupled to a front catch clip, a right catch clip and a left catch clip; and the cradle assembly further comprises a cradle assembly mounting mechanically coupled to a front cradle, a right cradle and a left cradle.

3. The shooting bench of claim 1, wherein the right leg assembly comprises a right leg is immediately adjacent right leg fixture; the right leg fixture is immediately adjacent to a right leg flange; the right leg flange is mechanically coupled to a right leg threaded stud which is threaded through the right leg assembly socket and into the tabletop;

the left leg assembly comprises a left leg is immediately adjacent left leg fixture; the left leg fixture is immediately adjacent to a left leg flange; the left leg flange is mechanically coupled to a left leg threaded stud which is threaded through the left leg assembly socket and into the tabletop; and the front leg assembly comprises a front leg is immediately adjacent front leg fixture; the front leg fixture is immediately adjacent to a front leg flange; the front leg flange is mechanically coupled to a front leg threaded stud which is threaded through the front leg assembly socket and into the tabletop.

* * * * *